United States Patent [19]

Williford

[11] Patent Number: 5,069,144

[45] Date of Patent: Dec. 3, 1991

[54] FOLDING FUNITURE

[76] Inventor: Jeffrey M. Williford, 1513 Paisley Ave., Fayetteville, N.C. 28304

[21] Appl. No.: 631,100

[22] Filed: Dec. 19, 1990

[51] Int. Cl.[5] ..... A47B 3/00

[52] U.S. Cl. ..... 108/129; 108/115; 312/258

[58] Field of Search ..... 108/115, 111, 160, 35, 108/47, 11, 34, 129, 128, 134; 312/258, 195, 108; 220/6

[56] References Cited

U.S. PATENT DOCUMENTS

| | | | |
|---|---|---|---|
| 330.721 | 11/1885 | McBlair | 108/134 |
| 502.778 | 8/1893 | Shrague | 312/258 |
| 3,845.727 | 11/1974 | Chase | 108/115 |
| 4,059.058 | 11/1977 | Kazuhide | 108/129 |
| 4,169,639 | 10/1979 | Zola | 312/265 |
| 4,286.831 | 9/1981 | Beers | 312/258 |

FOREIGN PATENT DOCUMENTS

| | | | |
|---|---|---|---|
| 3603898 | 8/1987 | Fed. Rep. of Germany | 312/358 |

*Primary Examiner*—Kenneth J. Dorner

*Assistant Examiner*—Gerald A. Anderson

[57] ABSTRACT

Folding furniture to be used as a table, pedestal, supporting structure or the like which may be easily collapsed into a low-volume configuration for portability and storage. The furniture generally consists of four panels which function as top, bottom and sides, hinged together to form a rectangular structure. Adjoining panels at two diagonally opposed corners of the rectangular structure contain axially aligned bores in a tongue-and-groove assembly, receiving pins to secure the adjoining panels; this assembly allows the adjoining panels to swing obtusely. Panels meeting at the other two diagonally opposed corners of the rectangular structure are attached with hinges, allowing the panels to swing acutely. The side panels contain variously shaped support members which are hinged to said side panels. The support members are pivotal toward the interior of the table structure to rest against an adjacent panel to prevent the side panels from folding from their upright position, thus stabilizing the overall structure in its erect state.

4 Claims, 5 Drawing Sheets

FOLDING FUNITURE

SUMMARY OF THE INVENTION

This invention relates to folding furniture, to be used as a table, pedestal, supporting structure or the like, which may be folded down into a thin, low-volume configuration for ease in portability, storage and shipping. The present invention also permits ease in assembly in the fact that all parts required for assembly are self-contained and attached to each other; there are no separate components. An object of this invention is to achieve the foregoing features with the capability of being mass produced.

The foregoing features are achieved in a structure, in accordance with the invention, consisting of four panels which function as top, bottom, and sides, hinged together to form a rectangular structure. Adjoining panels at two diagonally opposed corners of the rectangular structure contain axially aligned bores in a tongue and groove assembly, receiving pins to secure the adjoining panels; this assembly allows the adjoining panels to swing obtusely. Panels meeting at the other two diagonally opposed corners of the rectangular structure are attached with hinges, allowing the panels to swing acutely. The side panels contain variously shaped support members which are hinged to said side panels. The support members, when pivoted toward the interior of the structure, to a position generally perpendicular to the side panels, stabilize the overall structure in its upright position.

BRIEF DESCRIPTION OF THE DRAWING

A better understanding of the invention will arise with reference to the detailed description, of a preferred embodiment for the invention, to be read in conjunction with the accompanying drawings in which.

DESCRIPTION OF THE PREFERRED EMBODIMENT

Figure 1:
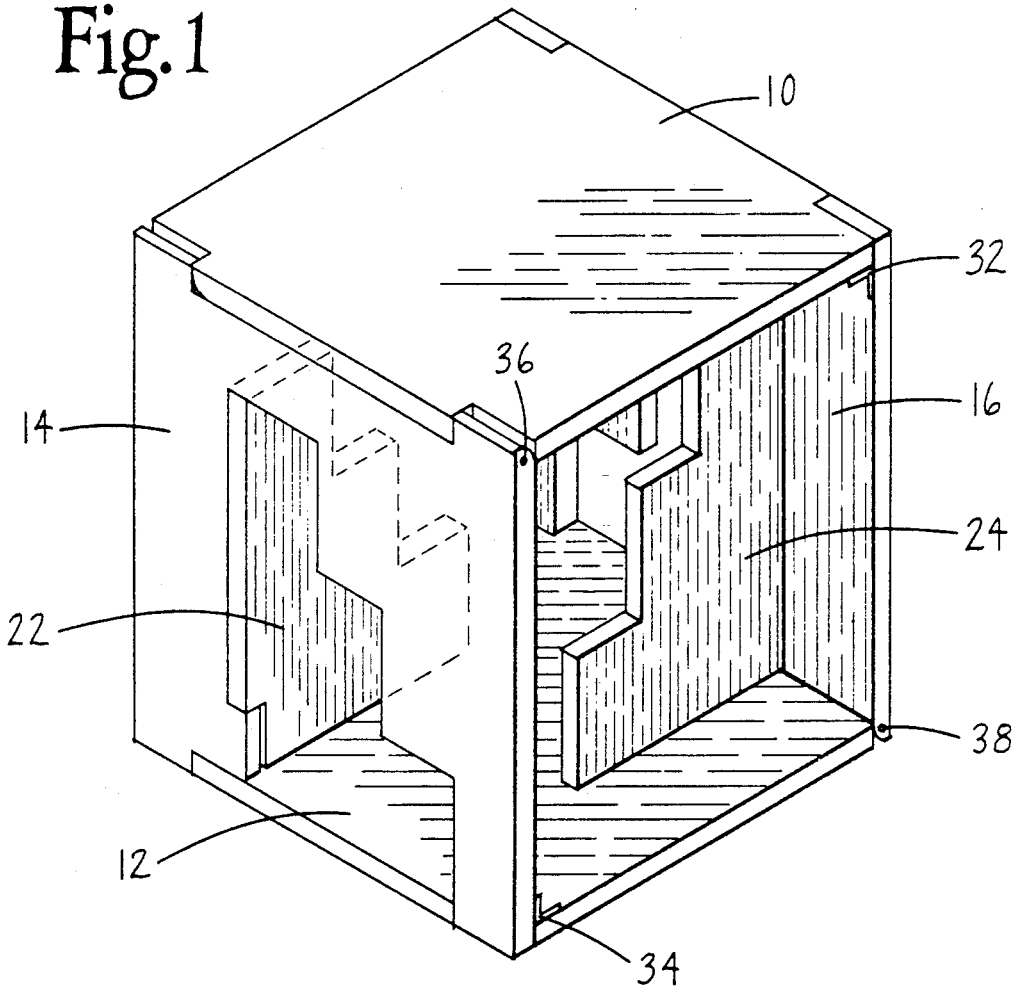
FIG. 1 is a perspective view of invention in upright, assembled state.
Figure 2:
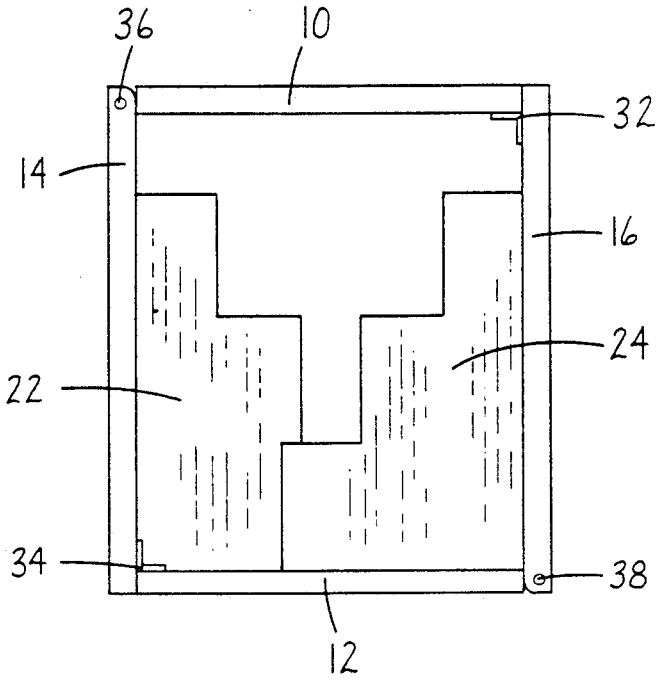
FIG. 2 is an elevational view of invention in upright, assembled state.
Figure 3:
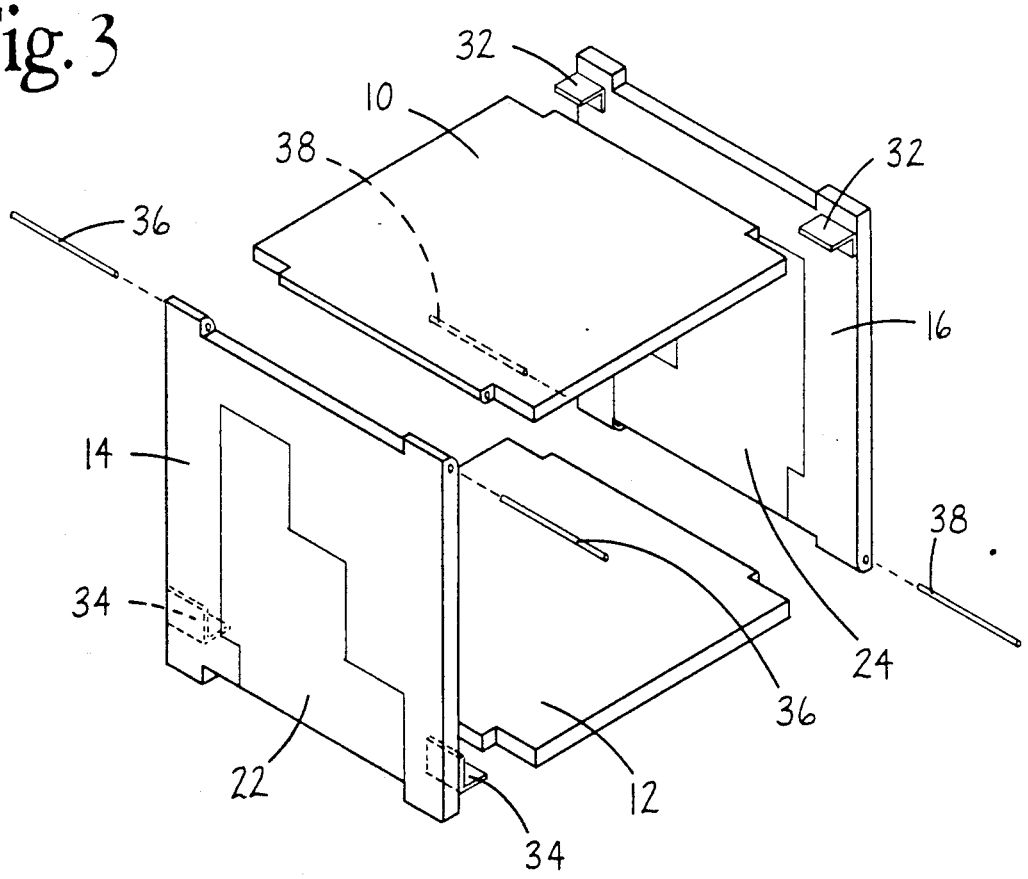
FIG. 3 is an exploded view of invention with support members folded into side panels.

With reference to FIGS. 1–5 in the accompanying drawings, it can be seen that the rectangular table structure generally comprises top and bottom panels (10 and 12) hinged to two side panels (14 and 16). The side panels 14 and 16 contain support members (22 and 24) which are hinged to said side panels. These support members, when folded towards the interior of the overall structure to a position generally perpendicular to the side panels and resting against bottom panel 12, brace the overall structure in its upright position.

Side panel 16 is attached to top panel 10 by hinges (32). Side panel 14 is similarly attached to bottom panel 12 by hinges (34). These hinged attachments, 32 and 34, allow each side panel to swing acutely towards its adjoining top or bottom panel.

The hinged attachments, connecting panel 10 to panel 14 and panel 12 to panel 16, are formed by pins (36 and 38) bored into the tongue-and-groove configuration of the adjoining panels, thus creating hinges which allow each side panel to swing obtusely from its adjoining top or bottom panel.

Figure 4:
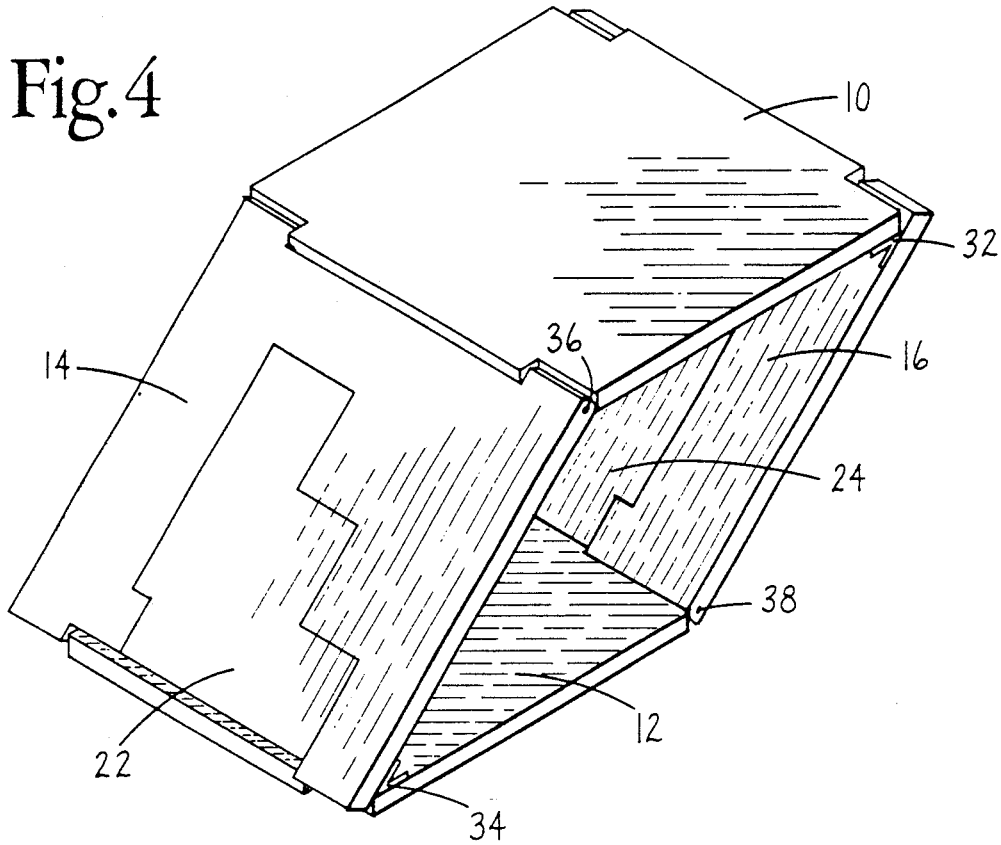
FIG. 4 is a perspective view of invention with support members folded into side panels, allowing overall structure to collapse.
Figure 5:
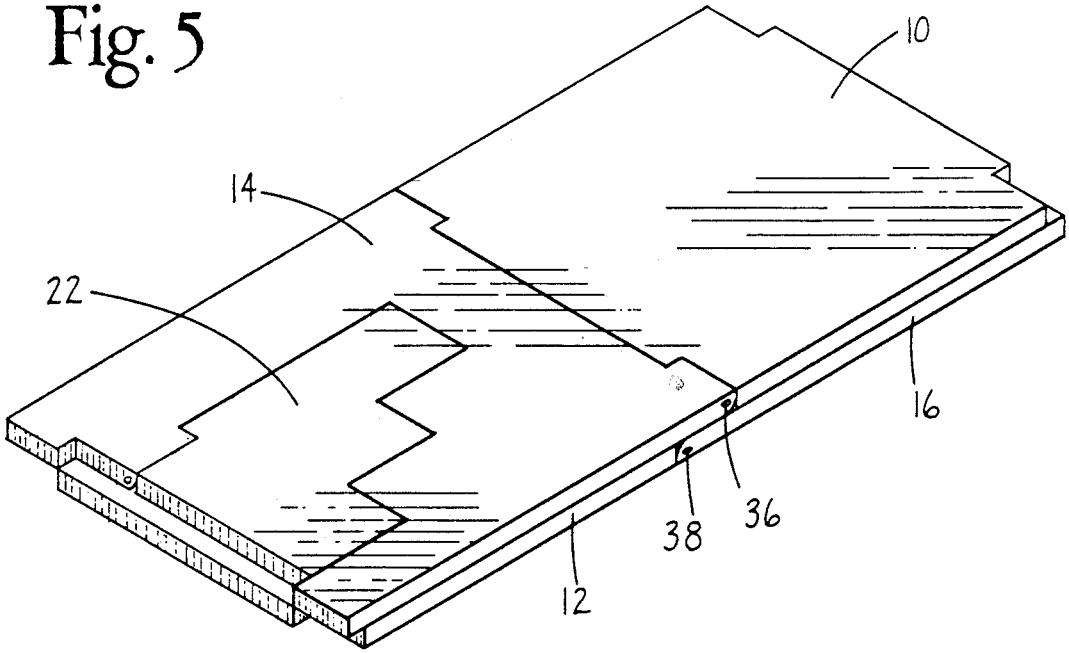
FIG. 5 is a perspective view of invention in its folded state.

The hinged relationships of panels 10, 12, 14, and 16 can be more easily understood with particular attention to FIG. 4 in which support members 22 and 24 have been folded into the side panels, allowing the structure to collapse towards its fully folded state, shown in FIG. 5.

Figure 6:
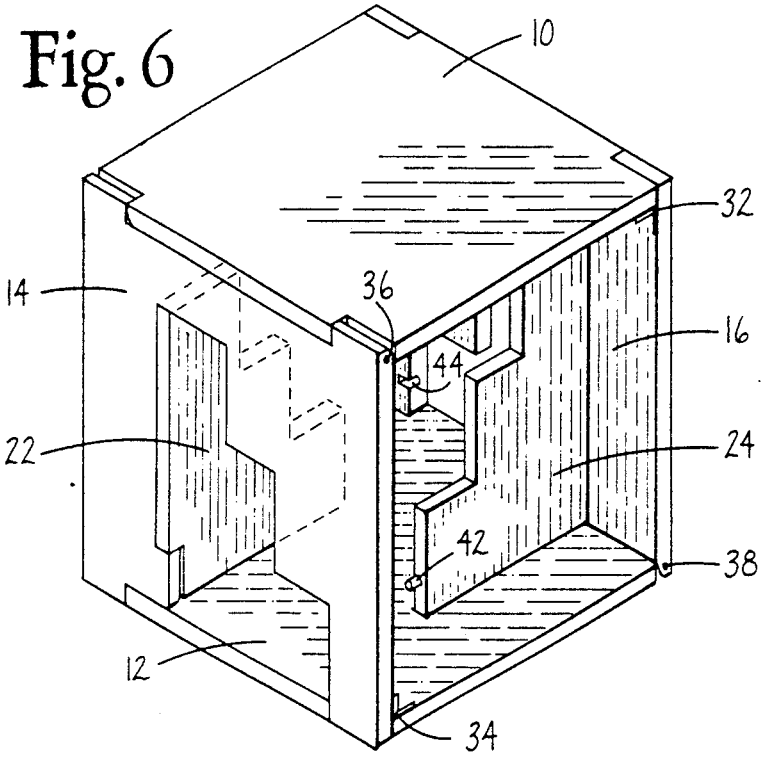
FIG. 6 is a perspective view of invention in which support members contain dowel projections.
Figure 7:
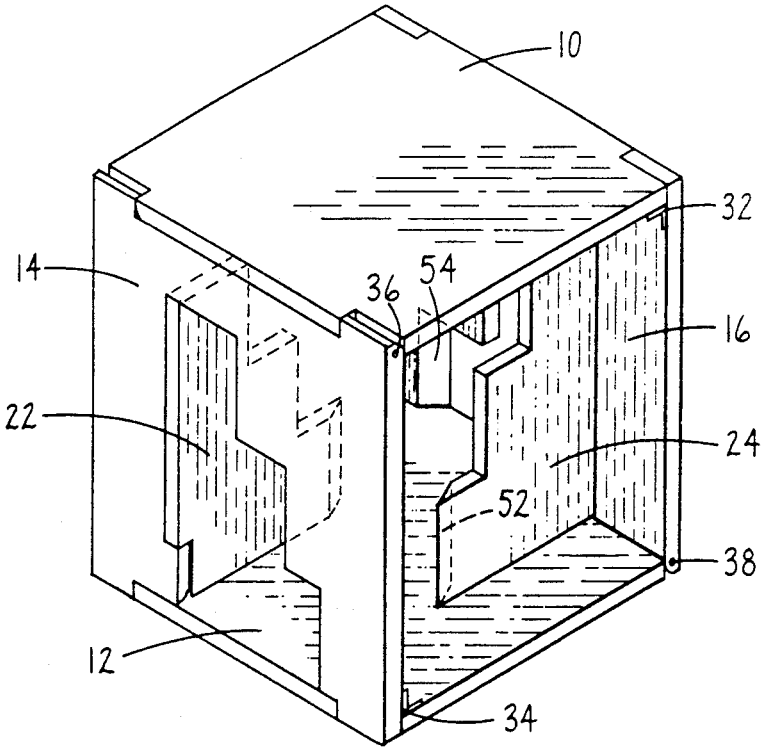
FIG. 7 is a perspective view of invention in which each support member has a beveled edge.

Support member 24 in FIG. 6 contains a small projecting dowel (42) which fits into corresponding groove (44), thus preventing the said support member from pivoting outside the perimeter of the table structure. FIG. 7 shows an alternative to dowel 42 and groove 44 (FIG. 6) in beveled edge (52) on the support member 24. This edge 52, when support member 24 is closed, fits against corresponding beveled edge (54) of side panel 16, thus preventing the said support member 24 from pivoting outside the perimeter of the table structure.

Figure 8:
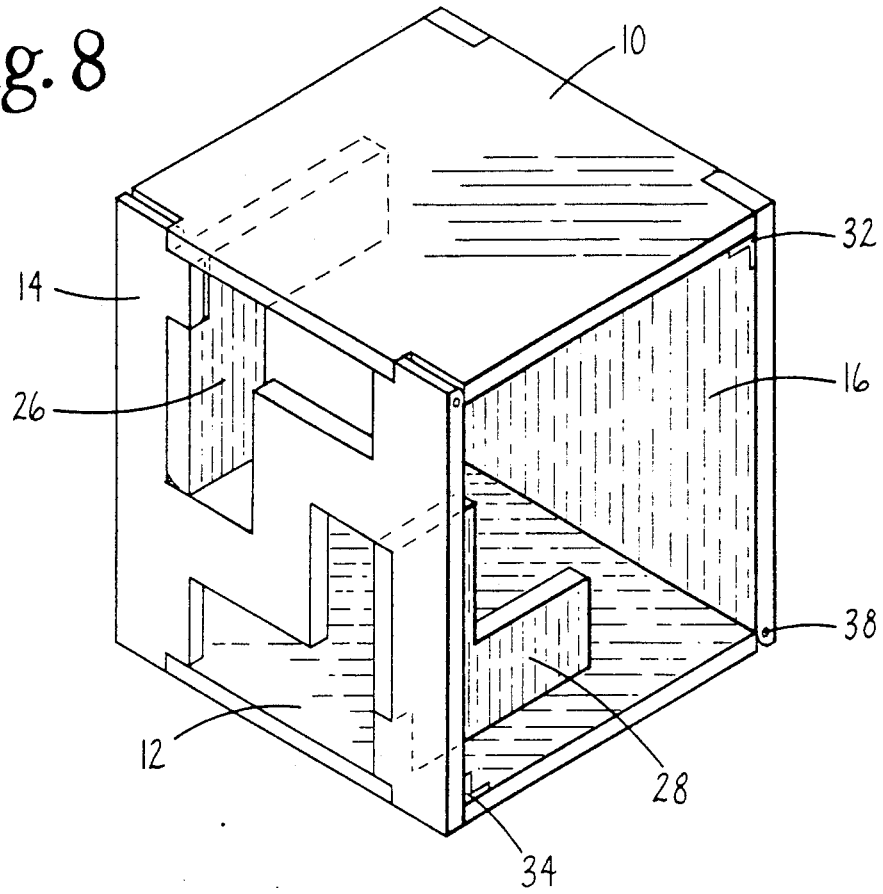
FIG. 8 is a perspective view of invention with alternative configuration of support members in assembled state.
Figure 9:
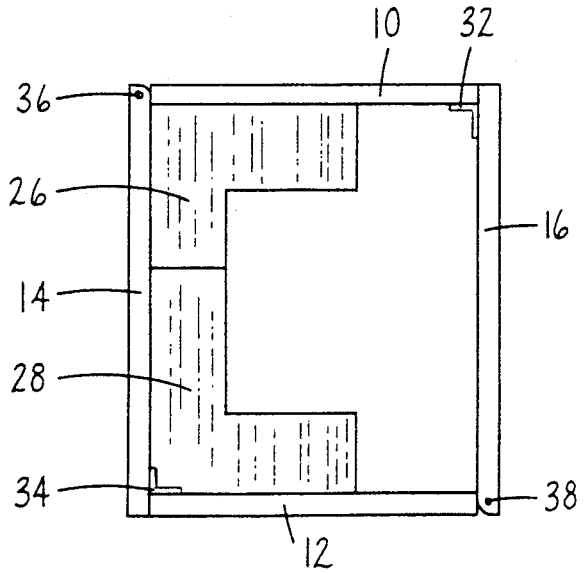
FIG. 9 is an elevational view of invention with alternative configuration of support members in assembled state.

It may be desirable for structural and/or aesthetic purposes for one or both side panels to contain multiple support members. An example of this is shown in FIGS. 8–9, in which side panel 14 contains two support members (26 and 28).

It will be obvious to those skilled in the art that the assembled table shown in FIG. 1 may be inverted, making panel 12 the table top and panel 10 the bottom.

What is claimed:

1. Folding furniture comprising four panels hinged together to form a rectangular structure; the said four panels serving as top, bottom, and side panels of the rectangular structure; adjoining panels at two diagonally opposed corners of the rectangular structure, having axially aligned bores, in a tongue and groove assembly, receiving pins to secure the adjoining panels, allowing said panels to swing obtusely; panels meeting at the other two diagonally opposed corners of the rectangular structure being attached with hinges, allowing said panels to swing acutely; said side panels of the rectangular structure containing support members hinged to said side panels and pivotal from the plane of said side panels toward the interior of rectangular structure to rest against a panel adjacent to said side panels to support the overall structure in an erected position.

2. Folding furniture as set forth in claim 1 wherein at least one of said side panels contains multiples of said support members.

3. Folding furniture as set forth in claim 1 wherein at least one said support member contains a dowel projecting from an edge of said support member; said dowel fits into groove in side panel adjacent to said support member; said dowel restricts support member from pivoting outside the perimeter of the overall furniture structure.

4. Folding furniture as set forth in claim 1 wherein at least one said support member contains a beveled edge; said beveled edge fits against beveled edge of said support member's adjacent side panel, restricting said support member from pivoting outside the perimeter of the overall furniture structure.

* * * * *